United States Patent [19]

Resendez, Jr.

[11] Patent Number: 4,660,902

[45] Date of Patent: Apr. 28, 1987

[54] LOCKING DEVICE

[76] Inventor: Henry N. Resendez, Jr., 2318 N. West Ave., Apartment 103, Fresno, Calif. 93705

[21] Appl. No.: 745,718

[22] Filed: Jun. 17, 1985

[51] Int. Cl.[4] ..... A47B 81/06

[52] U.S. Cl. ..... 312/114; 312/290; 312/216

[58] Field of Search ..... 312/114, 290, 138 R, 312/140, 216; 292/258, 285

[56] References Cited

U.S. PATENT DOCUMENTS

| | | | |
|---|---|---|---|
| 717,910 | 1/1903 | Paulle | 312/114 |
| 755,593 | 3/1904 | Durr | 312/138 R |
| 756,466 | 4/1904 | Brewer | 312/114 |
| 926,298 | 6/1909 | Simon | 312/114 |
| 1,744,866 | 1/1930 | Condon | 312/114 |
| 2,734,763 | 2/1956 | Dayhoff | 292/285 |

*Primary Examiner*—Kenneth J. Dorner
*Assistant Examiner*—Joseph Falk
*Attorney, Agent, or Firm*—Edward J. Pavsek, Jr.

[57] ABSTRACT

A locking device for securing the doors of a cabinet or the like of the type having a pair of doors mounted for hinged movement about spaced, substantially perpendicular axes, the device providing an engagement member adapted to be mounted on the cabinet, and a body portion adapted to be installed on one of the doors having a first retaining element and a second retaining element adapted to be disposed in restraining relation to the doors when the doors are disposed in a closed attitude, with a locking member borne by the first retaining element for lockable engagement with the engagement member.

15 Claims, 6 Drawing Figures

LOCKING DEVICE

BACKGROUND OF THE INVENTION

1. Field of the Invention.

The present invention relates to a locking device and more particularly to a locking device adapted simultaneously to secure a pair of doors or the like mounted on a cabinet of the type having doors mounted for independent hinged movement about substantially non-parallel axes.

2. Description of the Prior Art.

Cabinets of various constructions have long been provided for a wide variety of functional purposes. Of comparatively recent origin has been the introduction of cabinets adapted to store components of stereo, video recording, and other similar equipment. In particular, the construction of such cabinets which are suited for the storage of stereo equipment is typically such as to permit access not only to the control portions, but also to permit the placement and replacement of records on the turntable component of the stereo system housed by the cabinet.

Typically, such cabinets are constructed in one of several well-known forms. In one basic form, the cabinet provides an enclosure having substantially flat bottom, side and rear panels defining an interior cavity having a forwardly disposed, predetermined front opening and an upwardly disposed, predetermined upper opening. Typically, the cabinet provides a top door or closure panel hingedly secured on the rear panel of the cabinet for movement between a closed attitude wherein the top door is disposed in substantially covering relation to the upper opening and an opened attitude wherein the top door is disposed to permit access through the upper opening to articles contained within the cabinet. Typical conventional cabinets further commonly provide a predetermined front door or closure panel hingedly secured on a forward edge of one of the side panels for pivotal movement thereof about an axis substantially perpendicular and spaced from the axis about which the top door is adapted to pivot. The front door typically provides a side or free edge portion spaced from the edge portion thereof hingedly secured on the cabinet and the forward door is adapted to be disposed in a closed attitude wherein the free edge is disposed in predetermined relation to the side panel opposite that to which the front door is hingedly secured. In one common form, the free edge of the front door is adapted to be aligned with an interior face or surface of the side panel of the cabinet opposite that to which the door is hingedly secured. In another common conventional embodiment, the front door is dimensioned such that the free edge of the front door overlaps, or slightly extends beyond, the forward edge of the side panel of the cabinet opposite that to which the front door is hingedly secured.

While such conventional cabinets have great utility for their intended purposes, they typically do not provide means for securing the top and front doors thereof against unauthorized access to the interior of the cabinet and the articles contained therein. Inasmuch as the value of such articles, including stereo components, video recording equipment, and the like, is often considerable, intrusion into the cabinet by inquisitive children, pets and the like, can and often does result in damage to the articles, with consequent financial loss to the owner thereof.

Accordingly, it has long been known that it would be desirable to have a device adapted to secure the front and top doors of conventional cabinets to prevent the opening thereof and access to articles contained therein. More particularly, it has long been known that it would be desirable to have such a device which is adapted for use on cabinets of varying constructions and dimensions.

OBJECTS AND SUMMARY OF THE INVENTION

Therefore, it is an object of the present invention to provide an improved locking device adapted for use in securing the doors of conventional cabinets of the type commonly used for the storage of stereo equipment, video recording equipment, and the like.

Another object is to provide such a locking device which is operable to simultaneously secure a pair of such doors where the doors are hingedly mounted for movement about independent, non-parallel axes.

Another object is to provide such a locking device which is adapted for use on a variety of cabinets of differing constructions and dimensions.

Another object is to provide such a device which is quite compact and which is adapted to be installed on a typical cabinet without detracting significantly from the aesthetic characteristics of the cabinet.

Another object is to provide such a device which can be manufactured inexpensively for sale at a nominal price.

Further objects and advantages are to provide improved elements and arrangements thereof in a locking device which is economical, durable, reliable and effective in accomplishing its intended purposes.

DESCRIPTION OF THE PREFERRED EMBODIMENT

First Form

Figure 2:
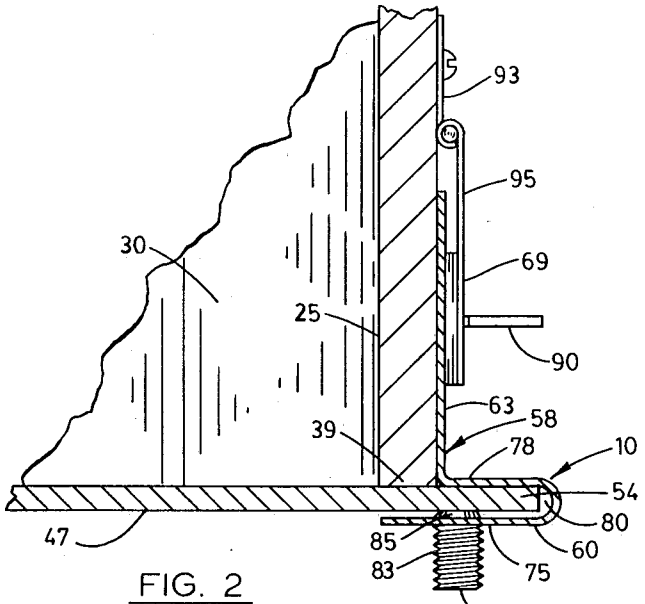
FIG. 2 is a somewhat enlarged transverse section taken on line 2—2 in FIG. 1.
Figure 3:
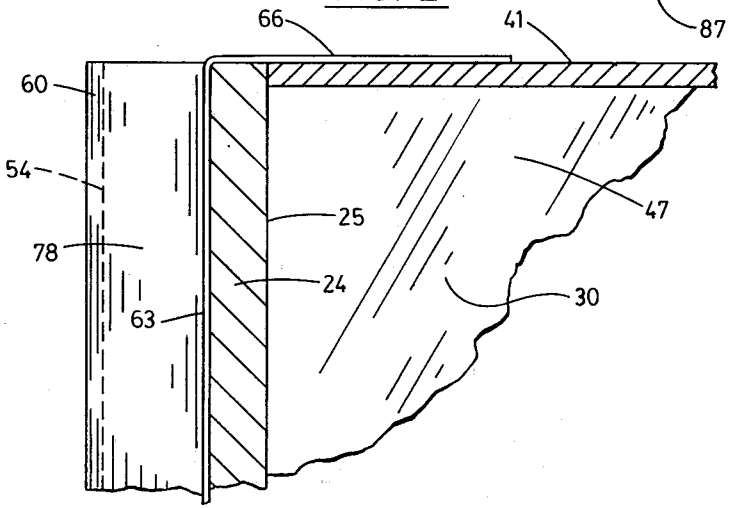
FIG. 3 is a somewhat enlarged transverse section taken on line 3—3 in FIG. 1.
Figure 1:
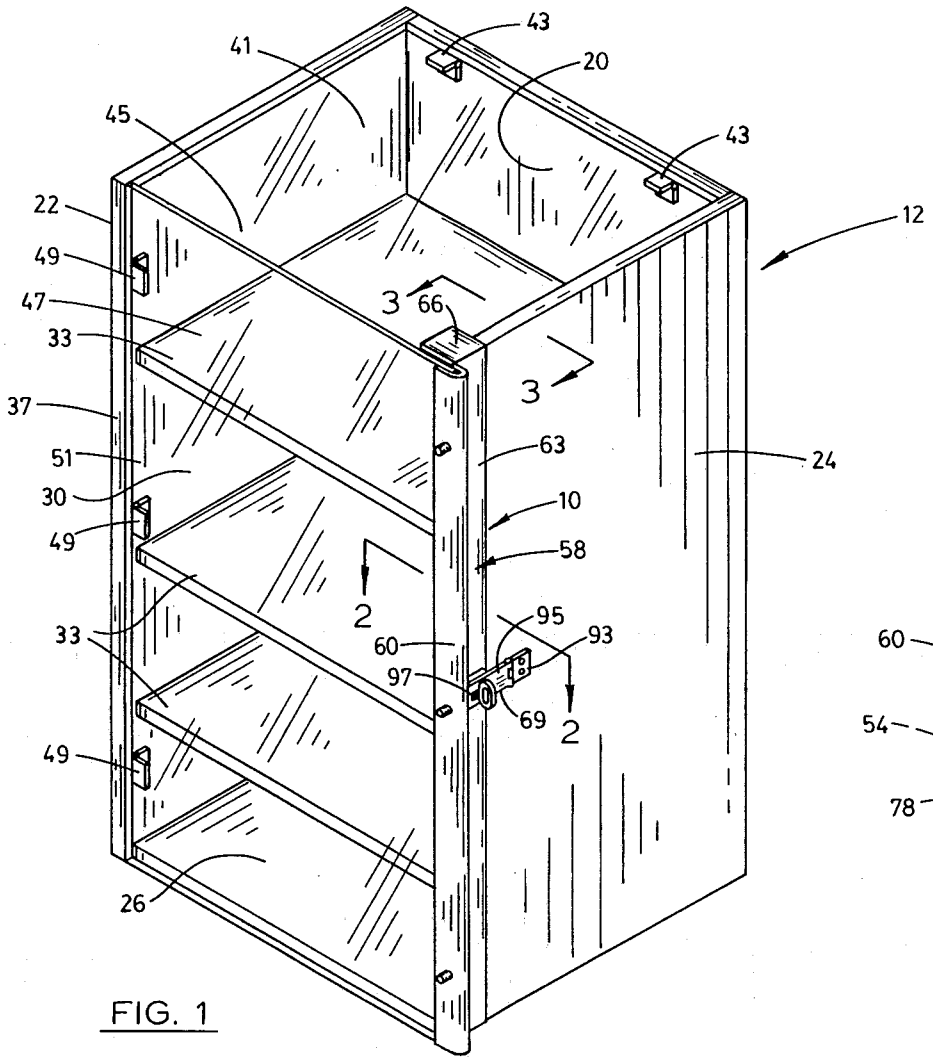
FIG. 1 is a perspective view of a first form of the locking device of the present invention shown deployed in a typical operational environment installed on a conventional cabinet.

A first form of the locking device of the present invention is illustrated in FIGS. 1, 2 and 3 and is designated generally by the numeral 10 therein. As can best be seen in FIG. 1, the locking device 10 is shown installed or mounted on a cabinet 12 of substantially conventional construction.

The cabinet 12 generally provides a substantially flat rear panel 20; a substantially flat, first side panel 22 secured in substantially perpendicular relation on the rear panel 20; and a substantially flat, second side panel 24 secured in substantially perpendicular relation to the rear panel 20 and spaced from the first side panel 22 a predetermined width. The second side panel has an interior face or surface 25. A substantially flat bottom panel 26 interconnects the rear panel 20, the first side panel 22 and the second side panel 24. Collectively, the first and second side panels, rear panel and bottom panel bound and incompletely enclose a cavity or chamber 30 of predetermined volume. Mounted within the chamber are a plurality of shelves 33 spaced incrementally upwardly of the bottom panel 26.

The first side panel 22 has a substantially straight, forward edge portion 37. The second side panel 24 has an elongated, substantially straight forward edge portion 39. A top panel or door 41 typically constructed of transparent material, such as glass or the like, is secured on the rear panel 20 as by hinges 43 and provides a forward edge portion 45 remote from and rear panel 20. The top door 41 is pivotable about an axis defined by the hinges 43 between the closed attitude illustrated in FIG. 1, wherein the top door is disposed in substantially occluding relation to the upwardly disposed opening of the chamber 30 and an opened attitude to permit access to the chamber.

A front panel or front door 47 is secured on the forward edge portion 37 of the first side panel 22 as by hinges 49 for movement thereof about an axis spaced from and substantially perpendicular to the axis defined by the hinges 43. The front door provides a hinged or first edge portion 51 mounted by the hinges 49 and a free or second edge portion 54 remote therefrom. The front door is movable between a closed attitude such as that illustrated in FIG. 1, wherein the front door is disposed in substantially occluding relation to the forwardly disposed opening of the chamber 30 and an opened attitude wherein the front door is swung outwardly from the cabinet to permit access to the chamber. As can best be seen in FIG. 2, the front door 47 is dimensioned to be disposed in substantially abutting or juxtaposed relation to the forward edge 39 of the second side panel 24 when the front door is disposed in a closed attitude. Further, the free edge portion 54 extends externally of the cabinet 12 beyond the second side panel 24.

The locking device 10 of the first form of the present invention generally provides a body portion 58 having a mounting portion 60; a first retaining element 63; and a second retaining element 66. The locking device further provides an engagement member or hasp portion 69.

The mounting portion 60 of the body portion 58 has a first, substantially flat, elongated plate 75 of a length equal to or less than that of the free edge portion 54 of the front door 47. A second elongated, substantially flat plate 78 is secured to and spaced from the first plate 75. The first plate 75 and second plate 78 bound a channel 80. As can best be seen in FIG. 2, the channel 80 is dimensioned loosely to receive a portion of the free edge portion 54 of the front door 47 therein. A plurality of biasing members 83 constructed in the form of screw-threaded set screws are spaced from each other and individually extend transversely through the first plate 75. Each biasing member 83 provides a first end portion 85 and an opposite, second end portion 87. The biasing members are screw-threadably adjustable to move the first end portion 85 toward and away from the second plate 78. As can best be seen in FIG. 2, the biasing members 83 are dimensioned and disposed to permit engagement of the free edge portion 54 of the front door 47 to bias the free edge portions against the second plate 78 to permit secure mounting retention of the body portion 58 on the front door 47 for movement therewith.

The first retaining element 63 is secured on the second plate 78 of the mounting portion 60 and extends substantially perpendicularly therefrom, as can best be seen in FIG. 2. The first retaining element is substantially flat and of a length substantially equivalent to that of the first plate 75 and second plate 78. The first retaining element is disposed in relation to the second plate 78 to permit the deployment thereof in substantially close juxtaposition with the second side panel 24 when the front door 47 on which the body portion 58 is installed is disposed in the closed attitude illustrated in FIGS. 1, 2 and 3.

The second retaining element 66 is substantially flat and extends substantially perpendicularly from the first retaining element 63. As can best be seen in FIGS. 1 and 3, the second retaining element 66 is dimensioned for deployment thereof in substantially close overlaying relation to portions of the forward edge portion 45 of the top door 41 when the front door 47 and the top door 41 are deployed in a closed attitude. When deployed in such overlaying relation, the second retaining element serves to limit movement of the top door 41 toward an opened attitude.

The first retaining element 63 mounts a substantially conventionally constructed locking member or key 90 rotatable about an axis substantially perpendicular to the second retaining element. The hasp portion 69 is of substantially conventional construction and provides a mounting plate 93 adapted to be secured as by screws, nails, or other adhesive or fastening means externally on the second side panel 24. A second plate 95 is hingedly secured on the mounting plate 93 and provides a keyway slot 97 dimensioned for insertion of the key 90 therethrough. The slot 97 is dimensioned to prohibit passage of the key 90 therethrough when the key is disposed in an attitude substantially in the manner of that illustrated in FIGS. 1 and 2 whereby, when so disposed, the key 90 and second plate 95 are releasably, lockably engaged to prevent movement of the front door toward an opened attitude.

Second Form

Figure 5:
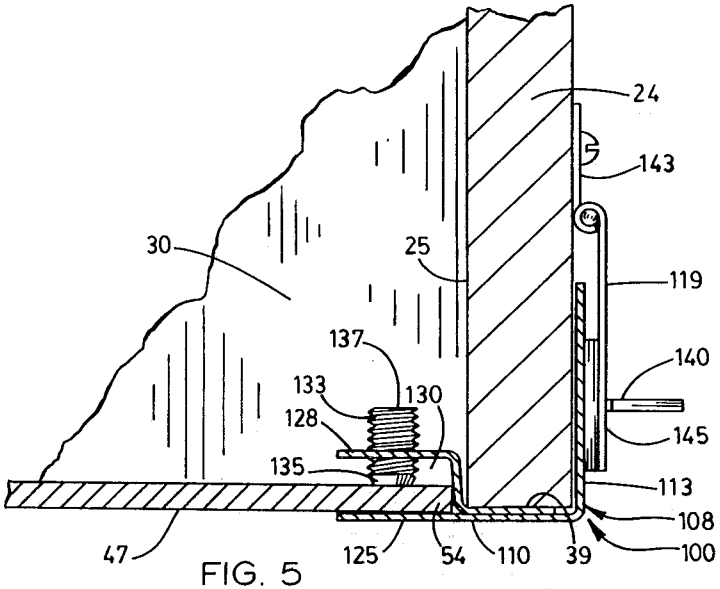
FIG. 5 is a somewhat enlarged transverse section taken on line 5—5 in FIG. 4.
Figure 6:
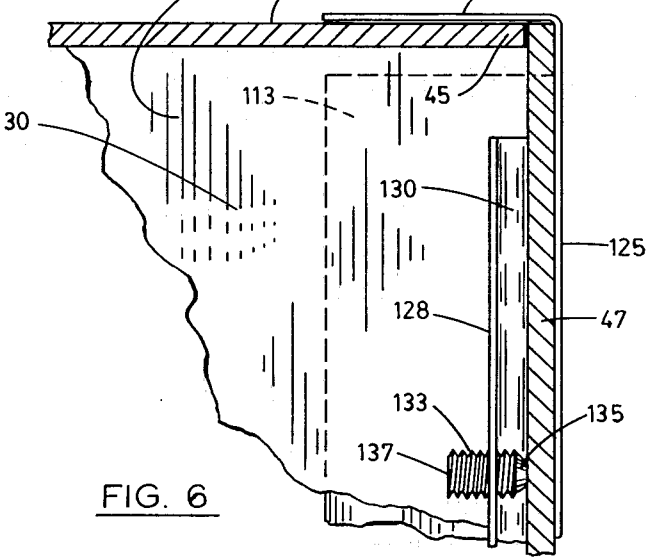
FIG. 6 is a somewhat enlarged transverse section taken on line 6—6 in FIG. 4.
Figure 4:
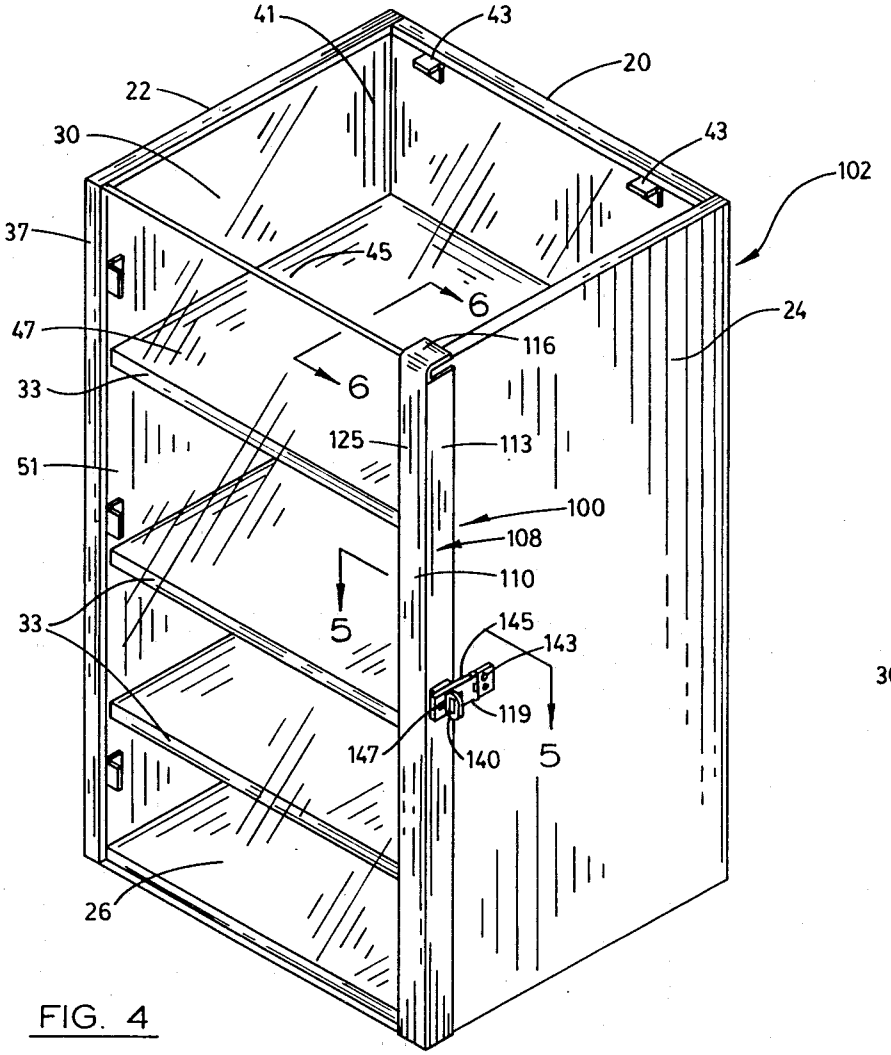
FIG. 4 is a perspective view of a second form of the locking device of the present invention shown deployed in a typical operational environment installed on a second type of conventional cabinet differing slightly in its construction from that shown in FIG. 1.

A second form of the preferred embodiment of the present invention is illustrated in FIGS. 4, 5 and 6 and is designated by the numeral 100 therein. As shown therein, the locking device 100 is depicted installed on a cabinet 102 of a construction substantially similar to that of the cabinet 12 shown in FIGS. 1, 2 and 3, but differing therefrom primarily in the following regard. Whereas the free edge portion 54 of the front door 47 of the cabinet 10 is dimensioned to extend externally beyond side panel 24 in a closed attitude, the corresponding structure in the cabinet 102 is dimensioned to permit juxtaposition thereof with the interior surface 25 of the second side panel 24 in a closed attitude. This being the primary difference in structure between cabinets 12 and 102, like reference numerals are utilized for corresponding structural elements in FIGS. 4, 5 and 6, and reference is invited to the description in the immediately preceeding section.

The locking device 100 of the second form of the preferred embodiment of the present invention generally provides a body portion 108 having a mountingportion 110; a first retaining element 113; and a second retaining element 116. The locking device 100 further provides an engagement member or hasp portion 119.

The mounting portion 110 provides a first, elongated, substantially flat plate 125 of a length substantially equal to or less than that of the free edge portion 54 of the front door 47. A second, elongated plate 128 is secured to the first plate 125 and defines and bounds a channel 130 between the first plate and second plate. As can best be seen in Fig. 5, the channel 130 is dimensioned loosely to be received about the free edge portion 54 of the front door 47. A plurality of biasing members 133, constructed in the form of set screws or the like, extend through the second plate 128 and are spaced therealong substantially in the manner of the biasing members 83 of the locking device 10 of the first form of the preferred embodiment. The biasing members 133 each provide a first end portion 135 and an opposite, second end portion 137. The biasing members are individually screw-threadably adjustable to move the first end portion 135 thereof toward and away from the first plate 125. Accordingly, when the free edge portion 54 of the front door 47 is received within the channel 130, the biasing members 133 are screw-threadably adjustable to bias the free edge portion between the first end portions 135 and the first plate 125 to securely retain the body portion 108 upon the front door for movement therewith about the pivotal axis defined by the hinges 49. As can best be seen in FIG. 5, the second plate 128 is disposed substantially internally of the chamber 130 when the front door is disposed in a closed attitude.

The first retaining element 113 is substantially flat and extends substantially perpendicularly from the first plate 125. The first retaining element is elongated and is of a length slightly less than that of the first plate.

The second retaining element 116 is substantially flat and extends perpendicularly from the first plate 125 and is disposed substantially perpendicularly relative to the first retaining element 113. As can best be seen in FIGS. 4 and 6, the second retaining element is dimensioned to be disposed in substantially close, overlaying relation to a portion of the forward edgeportion 45 of the top door 41 when the top door and front door 47 are disposed in a closed attitude substantially in the manner illustrated in FIG. 4. In such a closed attitude, the second retaining element is operable to limit or prevent movement of the top door toward an opened attitude.

As can best be seen in FIGS. 4 and 5, the first retaining element 113 is dimensioned to be disposed in close juxtaposition with an external portion of the second side panel 24 of the cabinet 102 when the front door 47 is disposed in a closed attitude.

The first retaining element 113 mounts an engagement member or key member 140 constructed and operable substantially in the manner of that of the key member 90 of the locking device 10. The hasp portion 119 is constructed substantially identically to that of the hasp portion 69 of the first form and, accordingly, provides a mounting plate 143 and a second plate 145 hingedly secured thereto and providing a keyway slot 147.

OPERATION

The operation of the first and second forms of the preferred embodiment of the present invention are believed readily understood and are briefly summarized at this point.

The locking device 10 of the first form of the preferred embodiment is utilized by initially installing the components thereof on a cabinet 12 of the type illustrated in FIGS. 1 through 3. The mounting portion 60 of the body portion 58 is aligned with the free edge portion 54 of the front door 47 of the cabinet 12 and deployed in capturing relation thereon with the free edge portion 54 disposed within the channel 80 defined by the first plate 75 and second plate 78. The biasing members 83 are screw-threadably adjusted to move the first end portion 85 of each biasing member toward and against the free edge portion 54 to bias the free edge portion against the second plate 78 of the mounting portion 60. The hasp portion 69 is secured on the exterior surface of the second side panel 24 as by screws or other fastening means in a position to dispose the keyway slot 97 to be received about the key 90 when the front door 47 is disposed in a closed attitude.

In order to secure the top door 41 and front door 47 against movement about their respective pivotal axes, both doors are deployed in a closed attitude. When so disposed, the second retaining element 66 is positioned slightly above the forward edge portion 45 of the top door 41 in restraining relation thereto. The second plate 95 of the hasp portion 69 is pivoted to receive the keyway slot 97 about the key 90. The key is then rotated approximately 90° to dispose it in a position to prevent movement of the second plate 95 about its hinge. A conventional lock, such as a padlock or the like, can then be secured on the key to prevent unauthorized release of the second plate 95 from the key. Accordingly, the locking device 10 prevents both the top door 41 and the front door 47 from being moved from their respective closed attitudes towards their respective opened attitudes.

The operation of the second form 100 of the preferred embodiment is substantially similar to that of the first form 10. That is, the hasp portion 119 is installed on the exterior surface of the second side panel 24 of a cabinet 102 of the type illustrated in FIGS. 4 through 6. The mounting portion 110 is then installed on the free edge portion 54 by disposing the free edge portion within the channel 130 defined by the first plate 125 and second plate 128. The biasing members 133 are then screw-threadably adjusted to move the first end portion 135 of each into biasing relation against the free edge portion 54 to securely retain the locking device 100 upon the front door.

As in the operation of the locking device 10 of the first form, the front door 47 and top door 41 are then deployed in a closed attitude and the hasp portion 119 is secured in the manner previously described with reference to the locking device 10. Accordingly, the second retaining element 116 is disposed in restraining relation to the top door 41 to prevent movement thereof from a closed attitude toward an opened attitude and the front door 47 is secured against movement away from its closed attitude.

The locking devices 10 and 100 of the first and second forms, respectively, of the preferred embodiment, can be constructed in a variety of configurations within the scope of the present invention. For instance, the first plate 75 and second plate 78 of the mounting portion 60 of the locking device 10 can be constructed having a length substantially less than that of the free edge portion 54 of the front door 47. Similarly, the first plate 125 and the second plate 128 of the mounting portion 110 of the locking device 100 can also be constructed having a shorter length. Further, the hasp and key portions of both the locking device 10 and locking device 100 can be constructed in the manner of a conventional self-locking hasp operable by means of a toothed key, thereby eliminating the need for a conventional padlock or the like.

The first plate 125 and second plate 128, and the first plate 75 and second plate 78, can be constructed as being convergent toward, or disposed obliquely relative to and spaced from each other to make the mounting portions 110 and 60, respectively, substantially self-biasing to permit mounting thereof without the need for biasing members 158 and 83. Also optionally, the biasing members can be mounted by the first plate 78 and 128. Further, both locking devices can be constructed within the scope of the invention for installation on cabinets having front doors hinged on the edge portion opposite that illustrated in the drawings, in which case the locking devices would be substantially mirror images of those illustrated and described herein.

Therefore, the first and second forms of the present invention provide means for securing the top and front doors of conventionally constructed cabinets of the types illustrated in the drawings, as well as cabinets constructed similarly thereto. Further, the locking devices of the present invention can be constructed substantially compactly without loss of functionality and without diminishing the esthetic value of cabinets on which they are installed. Moreover, the locking devices of the present invention provide simple yet fully effective means for simultaneously retaining two doors hinged for movement about substantially perpendicular axes without the need for the employment of more than one locking device.

Although the invention has been herein shown and described in what are conceived to be the most practical and preferred embodiments, it is recognized that departures may be made therefrom within the scope of the invention, which is not to be limited to the illustrative details disclosed.

Having described my invention, what I claim as new and desire to secure by Letters Patent is:

1. In combination with a cabinet of the type providing a substantially flat predetermined rear panel; a first substantially flat side panel secured on the rear panel in forwardly extending substantially perpendicular relation thereto; a second substantially flat side panel spaced from the first side panel and secured on the rear panel in forwardly extending substantially perpendicular relation thereto and having a forward edge portion spaced therefrom; a bottom panel interconnecting the rear panel and first and second side panels, the bottom panel, side panels and rear panel collectively defining an internal chamber of predetermined volume bounded thereby and having a predetermined upwardly disposed opening and a predetermined forwardly disposed opening; a top door hingedly mounted on the rear panel for movement about an axis between a closed attitude wherein the top door is disposed in substantially occluding relation to the upwardly disposed opening and an opened attitude wherein the top door is disposed in substantially non-occluding relation to the upwardly disposed opening; and a front door having a first edge portion hingedly mounted on the first side panel for movement of the front door about an axis in spaced, substantially perpendicular relation to the axis of movement of the top door, and a second edge portion remote from the first edge portion, the front door being movable between a closed attitude wherein the front door is disposed in substantially occluding relation to the forwardly disposed opening and an opened attitude wherein the front door is disposed in substantially non-occluding relation to said opening, a device comprising:

a body portion removably mounted on a first one of the doors of the cabinet and providing a first retaining element mounting a locking member and a second retaining element dimensioned to be disposed in impeding relation to the other door when both doors are disposed in a closed attitude to limit movement of said other door toward an opened attitude; and an engagement member removably secured on a side panel of the cabinet and operable to be releasably lockably engaged by the locking member when the first one of the doors is disposed in a closed attitude to limit movement of said first one of the doors toward an opened attitude.

2. The device of claim 1 wherein the body portion is mountable on the front door of the cabinet.

3. The device of claim 2 wherein the body portion is mountable on the second edge portion of the front door.

4. The device of claim 3 wherein the body portion provides a first plate and a second plate bounding a channel therebetween dimensioned to be deployed in capturing relation on the second edge portion of the front door.

5. The device of claim 4 wherein one of the first and second plates mounts at least one biasing member movable toward the other of said plates to bias the second edge portion of the front door thereagainst.

6. The device of claim 5 wherein the second retaining element is borne by the first retaining element.

7. The device of claim 6 wherein the first retaining element is substantially flat, and the second retaining element is substantially flat and is disposed in substantially perpendicular relation to the first retaining element.

8. The device of claim 7 wherein the first retaining element is disposed to be deployed in substantially close juxtaposition with the second side panel of the cabinet when the front door is disposed in a closed attitude.

9. The device of claim 5 wherein the second retaining element is borne by one of said first and second plates.

10. The device of claim 9 wherein the first retaining element is substantially flat, and the second retaining element is substantially flat and is disposed in substantially perpendicular relation to the first retaining element.

11. The device of claim 10 wherein the first retaining element is disposed to be deployed in substantially close juxtaposition with the second side panel of the cabinet when the front door is disposed in a closed attitude.

12. The device of claim 3 wherein the body portion provides a first plate and a second plate disposed in substantially oblique relation thereto and spaced therefrom to permit the second edge portion of the front door to be biased therebetween to secure the device on the front door.

13. In combination with a cabinet of the type providing a substantially flat predetermined rear panel; a first substantially flat side panel secured on the rear panel in forwardly extending substantially perpendicular relation thereto; a second substantially flat side panel spaced from the first side panel and secured on the rear panel in forwardly extending substantially perpendicular relation thereto and having a forward edge portion spaced therefrom; a bottom panel interconnecting the rear panel and first and second side panels, the bottom panel, side panels and rear panel collectively defining an internal chamber of predetermined volume bounded thereby and having a predetermined upwardly disposed opening and a predetermined forwardly disposed opening; a top door having a first edge portion hingedly mounted on the rear panel for movement about a predetermined axis, and a second edge portion remote from the first edge portion, the top door being movable between a closed attitude wherein the top door is disposed in substantially occluding relation to the upwardly disposed opening and an opened attitude wherein the top door is disposed in substantially non-occluding relation to the upwardly disposed opening; and a front door having a first edge portion hingedly mounted on the first side panel for movement of the front door about an axis in spaced, substantially perpendicular relation to the axis of movement of the top door, and a second edge portion remote from the first edge portion, the front door being movable between a closed attitude wherein the front door is disposed in substantially occluding relation to the forwardly disposed opening and an opened attitude wherein the front door is disposed in substantially non occluding relation to said opening, a device comprising:

a body portion removably mounted on the front door of the cabinet providing a first elongated, substantially flat plate; a second elongated, substantially flat plate secured to the first plate to define a channel therebetween dimensioned to receive a portion of the second edge portion of the front door therein to permit mounting of the device on the front door; a plurality of biasing members mounted by one of said plates, each biasing member being adjustably movable toward the other of said plates to bias the second edge portion of the front door thereagainst to retain the body portion thereon for movement of the body portion therewith; a first substantially flat retaining element borne by one of the plates in substantially perpendicular relation thereto and mounting a locking member thereon, the first retaining element being disposed to be brought into juxtaposition with the second side panel upon movement of the front door to a closed attitude; and a second substantially flat retaining element borne by the first retaining element in substantially perpendicular relation thereto and dimensioned to be disposed in substantially overlaying relation to a portion of the second edge portion of the top door when the top door and front door are disposed in a closed attitude to limit movement of the top door toward an opened attitude;

and an engagement member removably secured on the second side panel externally of the cabinet and operable to releasably lockably engage the locking member when the front door is disposed in a closed attitude to limit movement of the front door toward an opened attitude.

14. In combination with a cabinet of the type providing a substantially flat predetermined rear panel; a first substantially flat side panel secured on the rear panel in forwardly extending substantially perpendicular relation thereto; a second substantially flat side panel spaced from the first side panel and secured on the rear panel in forwardly extending substantially perpendicular relation thereto and having a forward edge portion spaced therefrom; a bottom panel interconnecting the rear panel and first and second side panels, the bottom panel, side panels and rear panel collectively defining an internal chamber of predetermined volume bounded thereby and having a predetermined upwardly disposed opening and a predetermined forwardly disposed opening; a top door having a first edge portion hingedly mounted on the rear panel for movement about a predetermined axis, and a second edge portion remote from the first edge portion, the top door being movable between a closed attitude wherein the top door is disposed in substantially occluding relation to the upwardly disposed opening and an opened attitude wherein the top door is disposed in substantially non-occluding relation to the upwardly disposed opening; and a front door having a first edge portion hingedly mounted on the first side panel for movement of the front door about an axis in spaced, substantially perpendicular relation to the axis of movement of the top door, and a second edge portion remote from the first edge portion, the front door being movable between a closed attitude wherein the front door is disposed in substantially occluding relation to the forwardly disposed opening and an opened attitude wherein the front door is disposed in substantially non-occluding relation to said opening, a device comprising:

a body portion removably mounted on the front door of the cabinet providing a first elongated, substantially flat plate; a second elongated, substantially flat plate secured to the first plate to define a channel therebetween dimensioned to receive a portion of the second edge portion of the front door therein to permit mounting of the device on the front door; a plurality of biasing members mounted by one of said plates, each biasing member being adjustably movable toward the other of said plates to bias the second edge portion of the front door thereagainst to retain the body portion thereon for movement of the body portion therewith; a first substantially flat retaining element borne by one of the plates in substantially perpendicular relation thereto and mounting a locking member thereon, the first retaining element being disposed to be brought into juxtaposition with the second side panel upon movement of the front door to a closed attitude; and a second substantially flat retaining element borne by one of the plates in substantially perpendicular relation to the first retaining element and dimensioned to be disposed in substantially overlaying relation to a portion of the second edge portion of the top door when the top door and front door are disposed in a closed attitude to limit movement of the top door toward an opened attitude;

and an engagement member removably secured on the second side panel externally of the cabinet and operable to releasably lockably engage the locking member when the front door is disposed in a closed attitude to limit movement of the front door toward an opened attitude.

15. The device of claim 14 wherein the first one of said plates is positioned to be disposed substantially internally of the chamber of the cabinet when the front door is disposed in a closed attitude, and the plurality of biasing members are borne by the first plate.

* * * * *